US006951182B2

(12) United States Patent
Onweller

(10) Patent No.: US 6,951,182 B2
(45) Date of Patent: Oct. 4, 2005

(54) MARINE MOORING LINE VERMIN SHIELD

(76) Inventor: Arthur E. Onweller, 5052 S. Syndt Rd., Evergreen, CO (US) 80439

( * ) Notice: Subject to any disclaimer, the term of this patent is extended or adjusted under 35 U.S.C. 154(b) by 0 days.

(21) Appl. No.: 10/710,378

(22) Filed: Jul. 6, 2004

(65) Prior Publication Data

US 2005/0022711 A1 Feb. 3, 2005

Related U.S. Application Data

(63) Continuation-in-part of application No. 10/604,526, filed on Jul. 29, 2003.

(51) Int. Cl.[7] ..... B63B 17/00
(52) U.S. Cl. ..... 114/221 R
(58) Field of Search ..... 114/221 R

(56) References Cited

U.S. PATENT DOCUMENTS 2,421,151 A * 5/1947 Johnstone et al. ..... 114/221 R
3,016,034 A * 1/1962 Raistakka ..... 114/221 R
5,570,652 A * 11/1996 Ferland ..... 114/221 R
6,450,113 B1 * 9/2002 Onweller ..... 114/221 R

* cited by examiner

*Primary Examiner*—Sherman Basinger
(74) *Attorney, Agent, or Firm*—Roger A. Jackson

(57) ABSTRACT

A marine mooring line vermin shield to prevent the passage of vermin crawling along a marine mooring line from land to a pleasure craft, including a disc with a centrally located aperture through the disc, and a slot extending from the aperture to a periphery of the disc. The vermin shield also includes a closure that is urged to insert into the disc slot in a closed state compressing the mooring line against the aperture to secure the vermin shield against the mooring line. The closure may also be locked in the closed state. The closure can also be extracted from the disc slot in an open state to allow the mooring line to be removed from the aperture through the slot past the disc periphery.

21 Claims, 6 Drawing Sheets

MARINE MOORING LINE VERMIN SHIELD

This is a continuation in part application of U.S. patent application Ser. No. 10/604,526 filed Jul. 29, 2003 by Arthur E. Onweller.

TECHNICAL FIELD

The present invention generally relates to vermin control in a marine environment. More particularly, the present invention relates to preventing the passage of vermin crawling along a mooring line of a recreational pleasure craft from the shoreline and onto the pleasure craft.

BACKGROUND OF INVENTION

It has long been recognized in the prior art the problem of a vermin infestation of marine vessels who migrate from the shore line whether it is a dock, a marina, a beach, or any other means possible with the vermin crawling from land onto the marine vessel wherein the vermin are attracted to food, water, and an enclave for nesting in the hold of the marine vessel. Once the vermin are on the marine vessel numerous problems arise, such as sanitation issues with the food and water supply of the marine vessel and other safety issues wherein the vermin can chew on wiring insulation in the hold of the vessel potentially causing electrical short circuits and possibly fires. Trapping and catching vermin has proved difficult as they are nocturnal animals, and can move very swiftly, and have the ability to squeeze through a very small crevices and openings in the hold of the vessel. Once the vermin have nested in the hold of the vessel it is typically required that the vessel be fumigated and then attempt to remove the dead vermin from the vessel. From the smallest to the largest vessels it is frequently very difficult even after fumigation to remove all of the dead vermin, which in time works to create unsanitary conditions from the decaying vermin carcasses.

As all marine vessels must of necessity be anchored or docked occasionally on either the beach or a dock where there is a mooring line that is strung between the cleats typically on the deck of the vessel and on the dock, or between the cleat on the deck of the vessel and an anchor that is on the shoreline. Even though the vessel is typically surrounded by least 6 ft. laterally of water, the vermin has ready access to the vessel by simply crawling along the mooring line from the dock or shoreline and onto the vessel itself. It has long been recognized in the prior art that the use of a shield barrier placed upon the mooring line to obstruct the vermin's ability to crawl along a mooring line and onto the ship is a solution to this problem.

Typical prior art solutions have included the use of a disc or a plurality of discs that are split in a semi circular fashion to be able to clamp upon the mooring line so that the disk assembly is secured in place upon the mooring line, as the mooring line is typically at an inclined angle with respect to the water level and the shoreline. A number of the prior art devices also include a vermin trap that sometimes has a poisonous substance inside wherein the vermin upon crawling up the mooring line and encountering the barrier are trapped inside the barrier and subsequently killed. U.S. Pat. No. 1,060,993 to Maynard and U.S. Pat. No. 4,890,416 to Roberts disclose this type of vermin guard. Other similar types of vermin guards do not have the vermin trap and poisonous substance, but are of a very similar design in other respects namely U.S. Pat. No. 1,401,540 to Konig, U.S. Pat. No. 1,486,417 to Cheely, U.S. Pat. No. 5,570,652 to Ferland, and U.S. Pat. No. 2,617,378 to Osol all utilize the aspect of only having a physical barrier to stop the vermin from migrating or crawling along the mooring line onto the vessel. There are some more unique designs of vermin guards for vessels that attempt to overcome specific problems, one of which is when a vermin guard is used on a very large vessel such as a ship, gaining physical access to the mooring line can be difficult as the mooring line can be suspended much higher than a human's height above the water level. It is typically desired that the vermin guard be placed at an appreciable distance from the dock or shoreline, being at least 6 ft. or so to preclude the vermin from easily getting access to the mooring line on the vessel side of the barrier. Thus, some of the vermin guards have been designed to be installed on the mooring line remotely from the vessel deck. This is accomplished through the use of remote ropes or cables to the vermin guard to allow the mooring line clamping mechanism of the vermin guard to be opened and to then be clamped upon the mooring line by an individual on the vessel deck utilizing the attached ropes or cables. Examples would be U.S. Pat. No. 4,570,564 to Salvarezza, U.S. Pat. No. 3,753,416 to Haglund et al., U.S. Pat. No. 3,005,436 to Caldwell, and U.S. Pat. No. 2,525,234 to Mucke of which all disclose the ability to remotely mount and dismount the vermin guard from the mooring line. Salvarezza and Haglund et al., utilize a swinging door closure that clamps on the mooring line by virtue of gravity, Caldwell utilizes a resilient member to clamp on the mooring line, and Mucke utilizes a spring clamp to secure the vermin guard to the mooring line. One other type of vermin guard utilizes only a repellent type substance wrapped around a mooring line absent a physical barrier for the vermin crawling along is disclosed in U.S. Pat. No. 4,769,943 to Simpson The majority of the aforementioned prior art has been designed for use with large vessels with the possible exception of Roberts and Simpson who both utilize a poisonous substance to prevent the vermin from crawling along the mooring line to the vessel. As the use of a poisonous substance in conjunction with pleasure craft or recreational boating is not desirable due to the presence of children and various other reasons, there remains a need for vermin guard that is specifically designed for smaller recreational pleasure marine craft that utilizes a physical barrier only without the use of a poisonous substance to prevent vermin from crawling along and mooring line. The vermin guard for smaller craft should also be small, lightweight, easy to install, inexpensive to produce, and desirably float on the water if the vermin guard were inadvertently dropped into the water.

SUMMARY OF INVENTION

An object of the present invention is to prevent the passage of vermin crawling along a marine mooring line from the shoreline and onto the pleasure craft.

It is another object of the present invention is to provide for easy installation and removal of the marine mooring line vermin shield from the mooring line.

It is still another object of the present invention to provide for a locking mechanism to selectively secure the marine mooring line vermin shield to the mooring line to help prevent theft of the mooring line vermin shield.

It is further another object of the present invention to accommodate a plurality of mooring line diameters or sizes.

According to the present invention, then, a marine mooring line vermin shield is provided to prevent the passage of vermin crawling along a marine mooring line from land to a pleasure craft. Broadly, the present invention includes a disc having a disc axial axis perpendicular to a face of the disc, the disc axial axis being positioned in a central portion of the disc. The disc also includes an aperture through the disc coincident to the disc axial axis being positioned such that the aperture uses the disc axial axis as a centerline, with the aperture being sized and configured as a passage for the marine mooring line. The disc also includes a radial slot through the disc coincident to the disc axial axis, the radial slot extending from the aperture to a periphery of the disc, with the slot having a radial axis parallel to the slot.

In addition, the present invention includes a closure sized and adapted to insert into the slot in a closure pivotal movement arc approximately parallel to the disc axial axis. The closure is in a closed state when inserted into the slot and is substantially flush with the disc face, the closure is also sized and adapted to manually extract from the slot in the closure pivotal movement arc approximately parallel to the disc axial axis. The closure is in an open state when extracted from the slot to allow the marine mooring line to pass through the slot from the periphery to the aperture. The closure also includes a first end that is substantially flush with the disc periphery when the closure is in the closed state, with the closure also including an opposing second end adapted to partially compress the mooring line against the aperture when the closure is in the closed state. Wherein the disc resists axial movement along the mooring line when the closure is in the closed state with the disc face generally perpendicular to a mooring line axial axis. Further included in the present invention is a means for urging the closure from the open state to the closed state.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
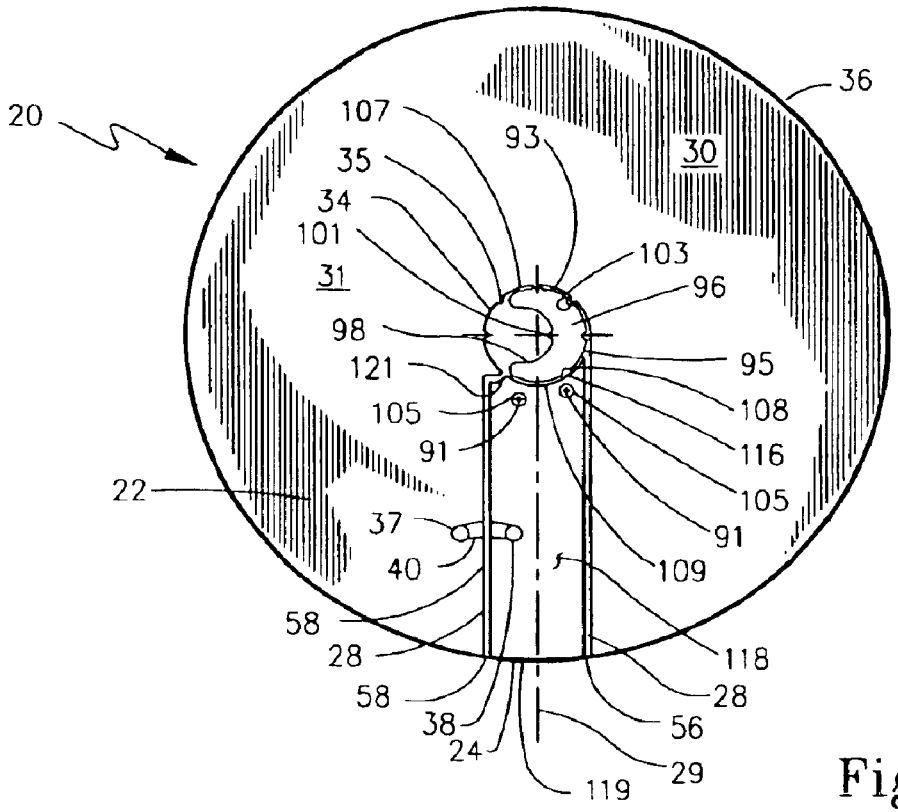
FIG. 1 shows a face front view of the marine mooring line vermin shield assembly with the closure including an optional removable aperture inserted into the disc slot, with the closure being in a closed state secured by an optional lockable element.

20 Marine Mooring Line Vermin Shield Assembly
22 Disc
24 Closure
25 Closure pivotal movement arc
26 Means for urging closure from the open state to the closed state
27 Hinge pivot bolt rod
28 Slot opening in disc for mooring line
29 Slot opening radial axis in disc
30 Disc face
31 Placement area for pleasure craft registration number
32 Disc axial axis perpendicular to disc face
34 Disc aperture or marine mooring line surface
35 Disc aperture protrusions
36 Disc periphery
37 Disc opening for lockable element
38 Closure opening for lockable element
39 Closure second end radial retainer
40 Lockable element
41 Closure second end female frustroconical shoulder
42 Closure second end female frustroconical segment
43 Closure second end channel
44 Disc closure rest
55 Pivotal axis between closure and disc
56 First disc closure clearance
57 Spring element
58 Second disc closure clearance
60 Closure rest
69 Compression of marine mooring line
71 Marine mooring line axial axis
72 Marine mooring line
73 Axial movement along marine mooring line
74 Land including shoreline or dock or marina
76 Body of water
78 Pleasure craft
79 Pleasure craft cleat

80 Vermin

81 Dock cleat

82 Anchor

84 Aperture insert ear

86 Aperture insert ear small end

88 Aperture insert ear male frustroconical segment

89 Aperture insert ear void side large end

90 Aperture insert ear radial retainer

91 Means for removably interlocking or engaging aperture insert to closure

92 Taper angle

93 Aperture insert outer surface

94 Neck

95 Aperture insert

96 Aperture insert face

97 Fastener opening in ear

98 Aperture insert mooring line surface

100 Aperture insert void

101 Aperture insert protrusion

102 Aperture insert mooring line surface radius axis

103 Aperture insert indentation

104 Aperture insert mooring line surface radius

105 Aperture insert to closure fasteners

106 Aperture insert mooring line surface radius intersection with axis

107 Aperture insert to disc aperture clearance

108 Closure protrusions

109 Aperture insert to closure second end clearance

111 Fastener opening in closure second end

116 Closure second end axial guide surface or mooring line surface

118 Closure face

119 Closure first end

120 Closure finger pull

121 Closure second end

122 Closure pivot mounts

124 Disc and closure reinforcing ribs

126 Disc pivot mounts

128 Hinge pivot retention nut

DETAILED DESCRIPTION

Figure 4:
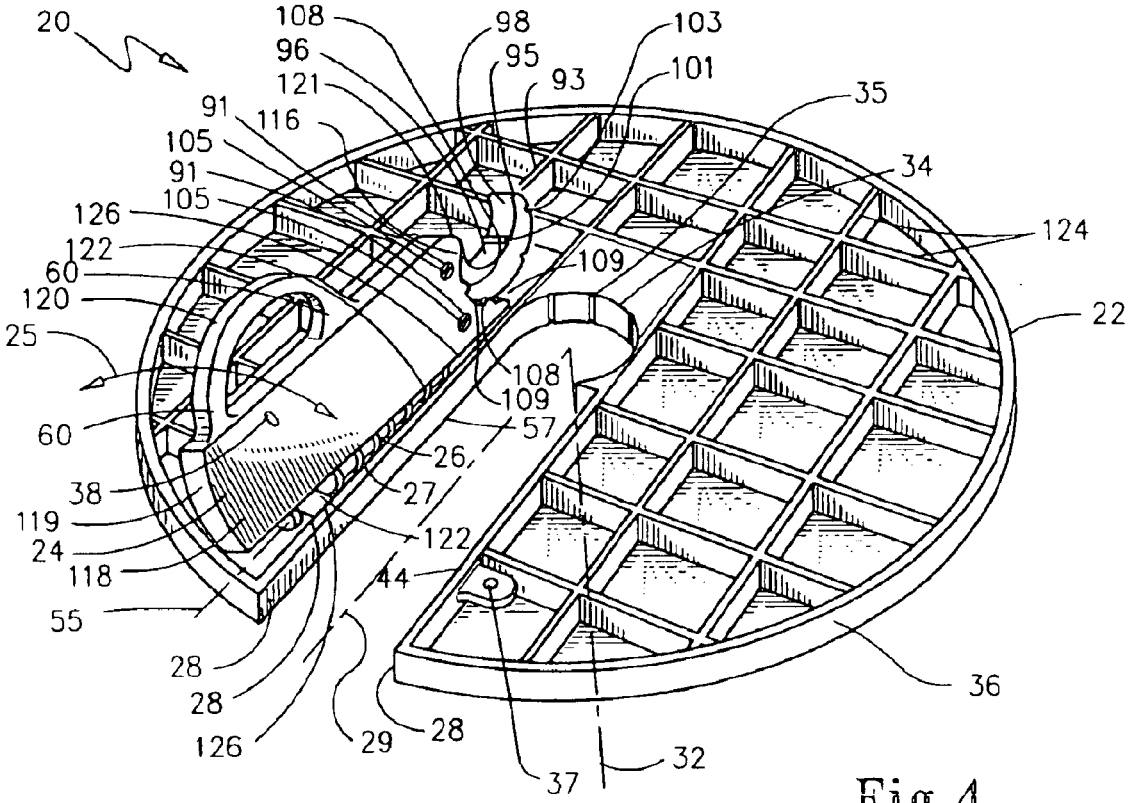
FIG. 4 shows a perspective view of the marine mooring line vermin shield assembly with the closure and the optional removable aperture insert extracted from the disc slot, resulting in the closure being in an unlocked and open state.

With initial reference to FIG. 1, shown is a face 30 front view of the marine mooring line vermin shield assembly 20 with the closure 24 having a removable aperture insert 95 with the closure 24 inserted into the radial disc slot 28, with the closure 24 being in a closed state. More specifically, the marine mooring line vermin shield assembly 20 is shown in a face 30 front view from the side opposite of the closure 24 pivotal attachment to the disc 22 to clearly identify the face 30 side of the disc 22. The mooring line vermin shield assembly 20 is shown with the disc face 30, which is the side that the vermin (not shown) would encounter while crawling along the mooring line (not shown) from land (see FIG. 11). This is desired as this face 30 is a substantially smooth or flush and continuous surface with the exception of the mooring line protruding therefrom thus making it difficult for the vermin to gain any traction to climb up the disc face 30 to get around the vermin shield 20 and continue upon the mooring line toward the pleasure craft (not shown, however, see FIG. 11) when the closure 24 is in the closed state. It is important to note that the closure 24, specifically the closure face 118, when in the closed state is substantially flush with the disc face 30 forming a continuous surface to effectively help block the vermin as previously described. In addition, the clearance gaps 56 and 58 respectively between the first disc 22 closure 24 clearance 56 to disc 22 slot 28 and the second disc 22 closure 24 clearance 58 to disc 22 slot 28 are minimal to also prevent the vermin from overcoming the shield 20. The disc radial slot 28 through the disc 22 is coincident to the disc axial axis 32 (as shown in FIG. 4), with the radial slot 28 extending from the aperture 34 to a periphery 36 of the disc 22, the slot has a radial axis 29 parallel to the slot 28.

Figure 10:
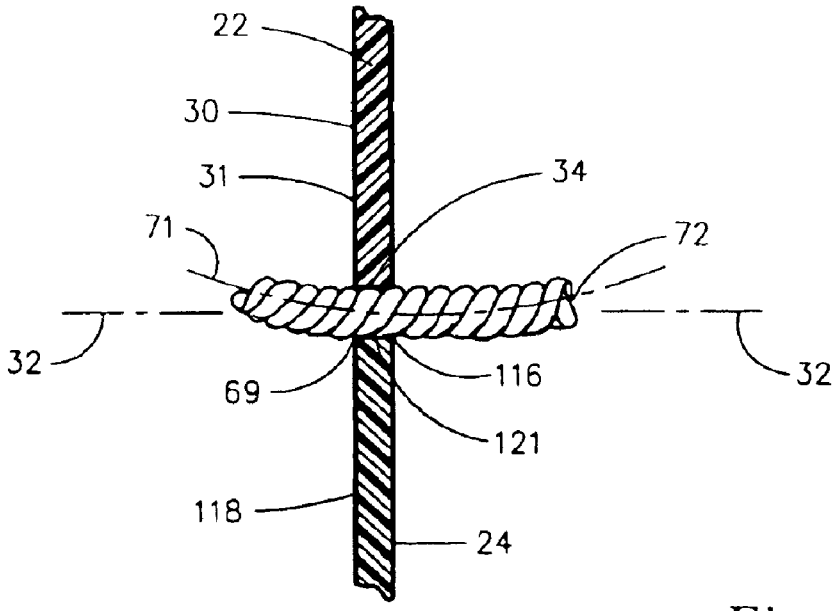
FIG. 10 shows section 10—10 from FIG. 9 of the marine mooring line vermin shield assembly with the closure not including the optional aperture insert for clarity, resulting in the closure being in a closed state, and the marine mooring line being compressed between the disc aperture and the closure second end.
Figure 9:
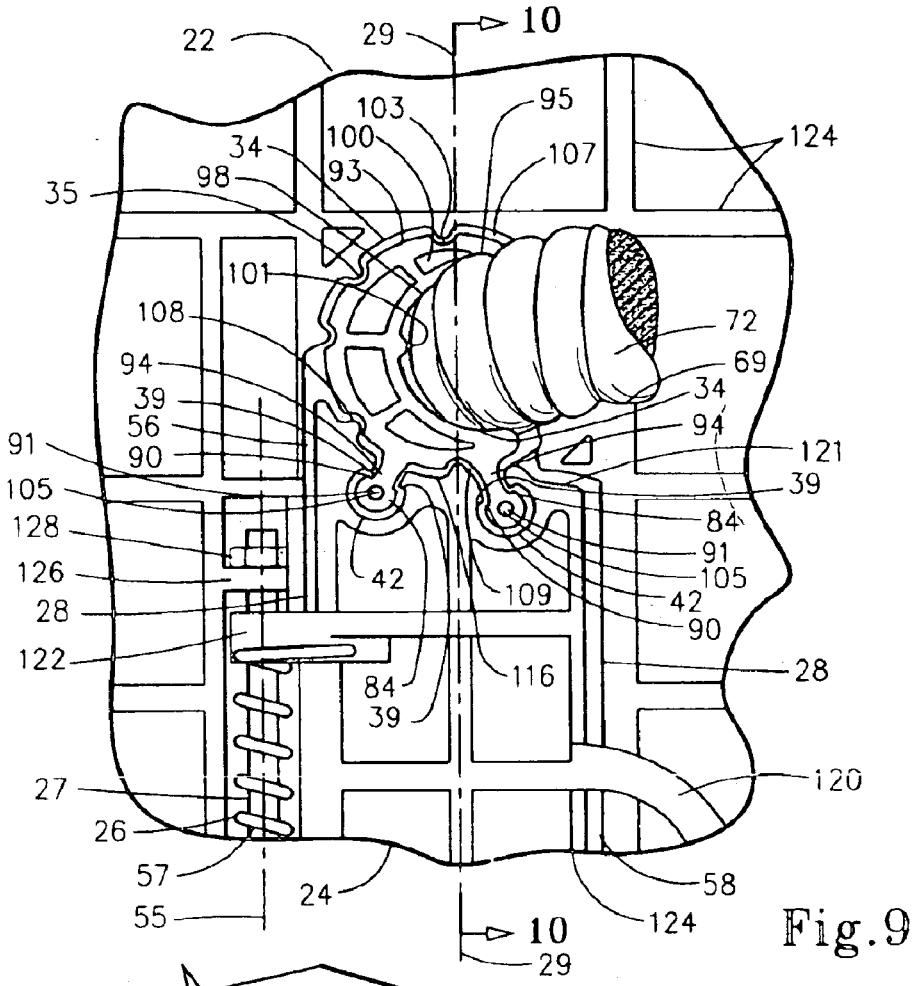
FIG. 9 shows an expanded back or rear view of the marine mooring line vermin shield assembly with the closure and the optional aperture insert both inserted into the disc slot, resulting in the closure being in a closed state with the marine mooring line compressed between the disc aperture and the aperture insert.

A mooring line passageway is formed by the disc aperture 34 and the aperture mooring line surface 98 of the aperture insert 95 or the closure mooring line surface 116, being a portion of the closure second end 121 as shown, if the aperture insert 95 is required depending upon the mooring line size as will be shown in FIG. 9 and FIG. 10. In other words, either the aperture mooring line surface 98 or as required for mooring line size the closure mooring line surface 116 act to compress the mooring line against the aperture 34 that is sized and configured as a passage for the marine mooring line 72 (not shown).

Figure 11:
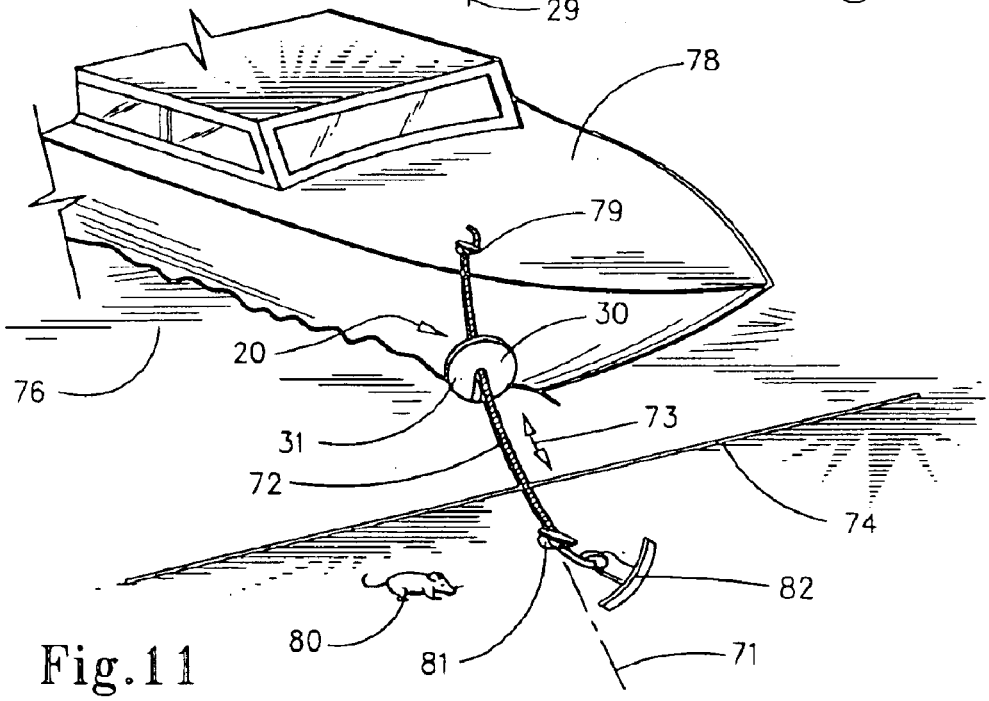
FIG. 11 shows the marine mooring line vermin shield assembly in use placed on a marine mooring line that secures the pleasure craft to the shoreline.

As an identification for the mooring vermin shield 20 the pleasure craft registration number can be added to the disc face 30 in the area shown by 31 to associate the vermin shield 20 to the pleasure craft, which is shown in FIG. 11. Also shown is the disc slot opening radial axis 29 and its relation to the second disc closure clearance 58 facing the non pivot end of the closure 24. The disc 22 has a periphery 36 with a closure first end 119 that is substantially flush with the disc periphery 36 when the closure 24 is in the closed state as shown to complete the formation of a nearly solid disc, being the combination of the disc 22 and the closure 24 when the closure 24 is in the closed state. The closure 24 first end 119 also includes an opposing second end 121 that in conjunction with the closure axial guide surface 116 is adapted to partially compress 69 the mooring line against the aperture 34 when the closure is in the closed state, in other words when the aperture insert 95 is not required due to the size of the mooring line (see FIGS. 9 and 10).

Looking more specifically to the aperture insert 95, the aperture insert 95 also has a face 96 that is substantially flush with the disc face 30 when the closure 24 is in the closed state as shown. The aperture insert 95 forms a minimal clearance gap 107 between the aperture insert 95 outer surface 93 and the disc 22 aperture 34 when the closure 24 is in the closed state to further complete the formation of a nearly solid disc, being the combination of the disc 22, the closure 24, and with the aperture insert 95 when required when the closure 24 is in the closed state. The attachment between the aperture insert 95 and the closure 24 is accomplished by a means 91 for removably interlocking the aperture insert 95 to the closure 24. Preferably the means 91 for removably interlocking the aperture insert 95 to the closure 24 utilizes fasteners 105 between the closure 24 and the aperture insert being described in more detail in FIGS. 3, 5, 6, 7, and 8. To better grip the mooring line, protrusions 35 are on the disc aperture or mooring line surface 34 of the disc 22, protrusions 101 are on the concave portion or mooring line surface 98 of the aperture insert 95, and protrusions 108 are on the closure second end 121 mooring line surface 116 of the closure 24. The protrusions 35, 101, and 108 all function to help grip the mooring line 72 (see FIG. 11) thus assisting in preventing the vermin shield 20 from sliding axially along the mooring line axial axis 71 (see FIG. 11). The protrusions 35, 101, and 108 are preferably about one sixteenth of an inch high and wide, however, the protrusions could be larger or smaller depending upon the type of mooring line 72 (not shown) used. In addition, the number of protrusions 35, 101, and 108 could vary depending upon the type of mooring line 72 (not shown) used. As the vermin shield 20 can be used without the aperture insert 95 for the largest size mooring lines, the protrusions that exist in between both the closure 24 protrusions 108 and the disc aperture 34 protrusions 35 to the aperture insert 95 are accommodated by aperture insert 95 indentations 103 that provide clearance for the closure 24 protrusions 108 and the disc aperture 34 protrusions 35. The indentations 103 are slightly larger by about one thirty second of an inch than protrusions 35 and 108. Thus, functionally the indentations 103 allow a close clearance 107 between the aperture insert 95 and the disc aperture 34 and a close clearance 109 between the closure 24 second end 121 axial guide surface 116 and the aperture insert 95, resulting in a nearly smooth face for the disc 22 face 30, aperture insert 95 face 96, and the closure 24 face 118 in conjunction with the closure 24 clearances 56 and 58 to the disc 22 slot 28 for the purpose of making vermin passage along the mooring line more difficult around the vermin shield 22 with the closure 24 in the closed state. Clearances 56, 58, 107, and 109 are preferably from about zero (0) to one sixteenth (1/16) of an inch. Also included is a lockable element 40 that loops through a disc opening 37 with the lockable element 40 continuing to loop through a closure opening 38 to help secure the closure 24 in the closed state, thus resulting in helping secure the vermin shield 20 to the mooring line. The lockable element 40 can be a cable type or a padlock type and the like, preferably the lockable element is a brand name ABUS Marine Brass model number 55/40 padlock sized at one and one half (1½) inches.

Figure 2:
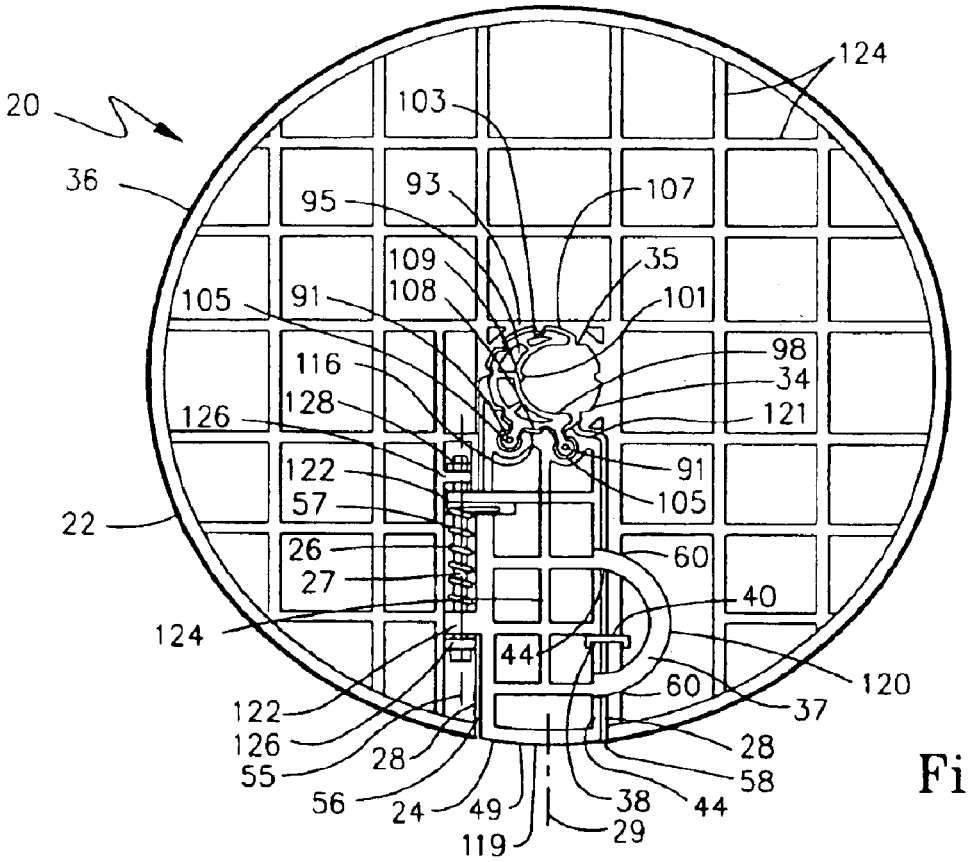
FIG. 2 shows a back or rear view of the marine mooring line vermin shield assembly with the closure including the optional removable aperture inserted into the disc slot, resulting in the closure being in a closed state secured by an optional lockable element.

Looking next to FIG. 2, shown is a back or rear view of the marine mooring line vermin shield assembly 20 with the closure 24 and removable aperture 95 slidably engaged into the closure 24 second end 121, with the combination of the closure 24 and the aperture insert 95 inserted into the disc slot 28, resulting in the closure 24 being in a closed state secured by the lockable element 40. The disc radial slot 28 through the disc 22 is coincident to the disc axial axis 32 (as shown in FIG. 4), with the radial slot 28 extending from the aperture 34 to a periphery 36 of the disc 22, the slot has a radial axis 29 parallel to the slot 28. More specifically, the marine mooring line vermin shield assembly 20 is shown in a back view from the side opposite of the substantially flush disc face (not shown) to clearly identify the components of the closure 24, the means 26 for urging the closure 24 from the open state to the closed state. The lockable element 40 is removed from the closure 24 opening 38 and disc 22 opening 37 to allow the closure 24 to be placed into the open state as best shown in FIG. 4. The disc 22 as shown assumes a round periphery 36. Although the disk periphery 36 as shown is round in shape it would be acceptable for the disc periphery 36 to assume a number of different configurations depending upon manufacturing, shipping, and use considerations. The disk periphery 36 could be square, rectangular, elliptical, egg shaped, or a polygon with any number of multiple straight sides. As shown the disc 22 and closure 24 have multiple disc reinforcing rib 124 construction, alternatively the disc 22 and closure 24 could be of a solid non rib construction. Materials of construction for the disk 22 are preferably of a material that is both corrosion resistant in a marine atmosphere and a material that has a mass density less that the mass density of water, to allow the disk to float in water while supporting the additional elements of the closure 24, the aperture insert 95, the means 26 for urging the closure into a closed state, and the lockable element 40. The preferred materials of construction for the disk 22 include a plastic that is both light in weight, strong, and easily manufactured. These disc 22 materials of construction could include polyethylene, polypropylene, and polyurethane type materials, however, the disk 22 materials would not be limited to the aforementioned plastics as any suitable alternative material for both manufacturing and use of the disk 22 in a marine environment would be acceptable. The materials of construction for the closure 24 and the aperture insert 95 if required could match that of the aforementioned disc 22. Also shown is the aperture 34 of the disc 22 that is a partially circular opening that utilizes the disc axial axis 32 (see FIG. 4) as a centerline. The opening formed by the disk 22 aperture 34 is substantially tangential to the slot 28.

The closure 24 as shown is in the closed state by being inserted into the slot 28 as urged by the means 26 for urging the closure 24 from the open state to the closed state. A mooring line passageway is formed by the disc aperture 34 and the aperture insert mooring line surface 98 of the aperture insert 95 or the closure mooring line surface 116, or as shown, if the aperture insert 95 is required depending upon the mooring line size as will be shown in FIG. 9 and FIG. 10. In other words, either the aperture mooring line surface 98 or as required for mooring line size the closure mooring line surface 116 act to compress 69 the mooring line (see FIG. 10) against the aperture 34.

The means 26 for urging the closure 24 from the open state into the closed state can be accomplished by any number of different elements. Preferably a spring element 57 positioned around a rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 integral to the disc 22 and closure pivot mounts 122 integral to the closure 24 are utilized as shown. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art that could function as a nut. The materials of construction of the rod 27 and the nut 128 are preferably stainless steel or from other materials being acceptable for a marine environment.

The closure 24 has a finger pull 120 to ease the manual operation of pivoting the closure 24 from the closed state to the open state. The finger pull 120 also acts as a closure rest 60 as against a disc rest 44 to limit the closure 24 pivotal movement 25 (see FIG. 4) from the means 26 for urging the closure 24 from the open state into the closed state, thus setting the closure 24 face 118 (see FIG. 1) in the closed state to be flush with the disc 22 face 30 (see FIG. 1). The disc 22 has a periphery 36 with a closure first end 119 that is substantially flush with the disc periphery 36 when the closure 24 is in the closed state as shown to complete the formation of a nearly solid disc, being the combination of the disc 22 and the closure 24 when the closure 24 is in the closed state. The closure 24 first end 119 also includes an opposing second end 121 that in conjunction with the closure axial guide surface 116 is adapted to partially compress the mooring line (see FIGS. 7 and 10) against the aperture 34 when the closure is in the closed state, in other words when the aperture insert 95 is not required due to the size of the mooring line.

Looking more specifically to the aperture insert 95, the aperture insert 95 forms a minimal clearance gap 107 between the aperture insert 95 outer surface 93 and the disc 22 aperture 34 when the closure 24 is in the closed state to further complete the formation of a nearly solid disc, being the combination of the disc 22, the closure 24, and with the aperture insert 95 when required when the closure 24 is in the closed state. The attachment between the aperture insert 95 and the closure 24 is accomplished by a means 91 for removably interlocking the aperture insert 95 to the closure 24. Preferably the means 91 for removably interlocking the aperture insert 95 to the closure 24 utilizes fasteners 105 between the closure 24 and the aperture insert being described in more detail in FIGS. 3, 5, 6, 7, and 8. To better grip the mooring line, protrusions 35 are on the disc aperture or mooring line surface 34 of the disc 22, protrusions 101 are on the concave portion or mooring line surface 98 of the aperture insert 95, and protrusions 108 are on the closure second end 121 mooring line surface 116 of the closure 24. The protrusions 35, 101, and 108 all function to help grip the mooring line 72 (see FIG. 11) thus assisting in preventing the vermin shield 20 from sliding axially along the mooring line axial axis 71 (see FIG. 11). The protrusions 35, 101, and 108 are preferably about one sixteenth of an inch high and wide, however, the protrusions could be larger or smaller depending upon the type of mooring line 72 (not shown) used. In addition, the number of protrusions 35, 101, and 108 could vary depending upon the type of mooring line 72 (not shown) used. As the vermin shield 20 can be used without the aperture insert 95 for the largest size mooring lines, the protrusions that exist inbetween both the closure 24 protrusions 108 and the disc aperture 34 protrusions 35 to the aperture insert 95 are accommodated by aperture insert 95 indentations 103 that provide clearance for the closure 24 protrusions 108 and the disc aperture 34 protrusions 35. The indentations 103 are slightly larger by about one thirty second of an inch than protrusions 35 and 108. Thus, functionally the indentations 103 allow a close clearance 107 between the aperture insert 95 and the disc aperture 34 and a close clearance 109 between the closure 24 second end 121 axial guide surface 116 and the aperture insert 95, resulting in a nearly smooth face for the disc 22 face 30 (not shown), aperture insert 95 face 96 (not shown), and the closure 24 face 118 (not shown) in conjunction with the closure 24 clearances 56 and 58 to the disc 22 slot 28 for the purpose of making vermin passage along the mooring line more difficult around the vermin shield 22. Clearances 56, 58, 107, and 109 are preferably from about zero (0) to one sixteenth (1/16) of an inch. Also included is a lockable element 40 that loops through the disc opening 37 with the lockable element 40 continuing to loop through the closure opening 38 to help secure the closure 24 in the closed state, thus resulting in helping secure the vermin shield 20 to the mooring line. The lockable element 40 can be a cable type or a padlock type and the like, preferably the lockable element is a brand name ABUS Marine Brass model number 55/40 padlock sized at one and one half (1½) inches.

Figure 3:
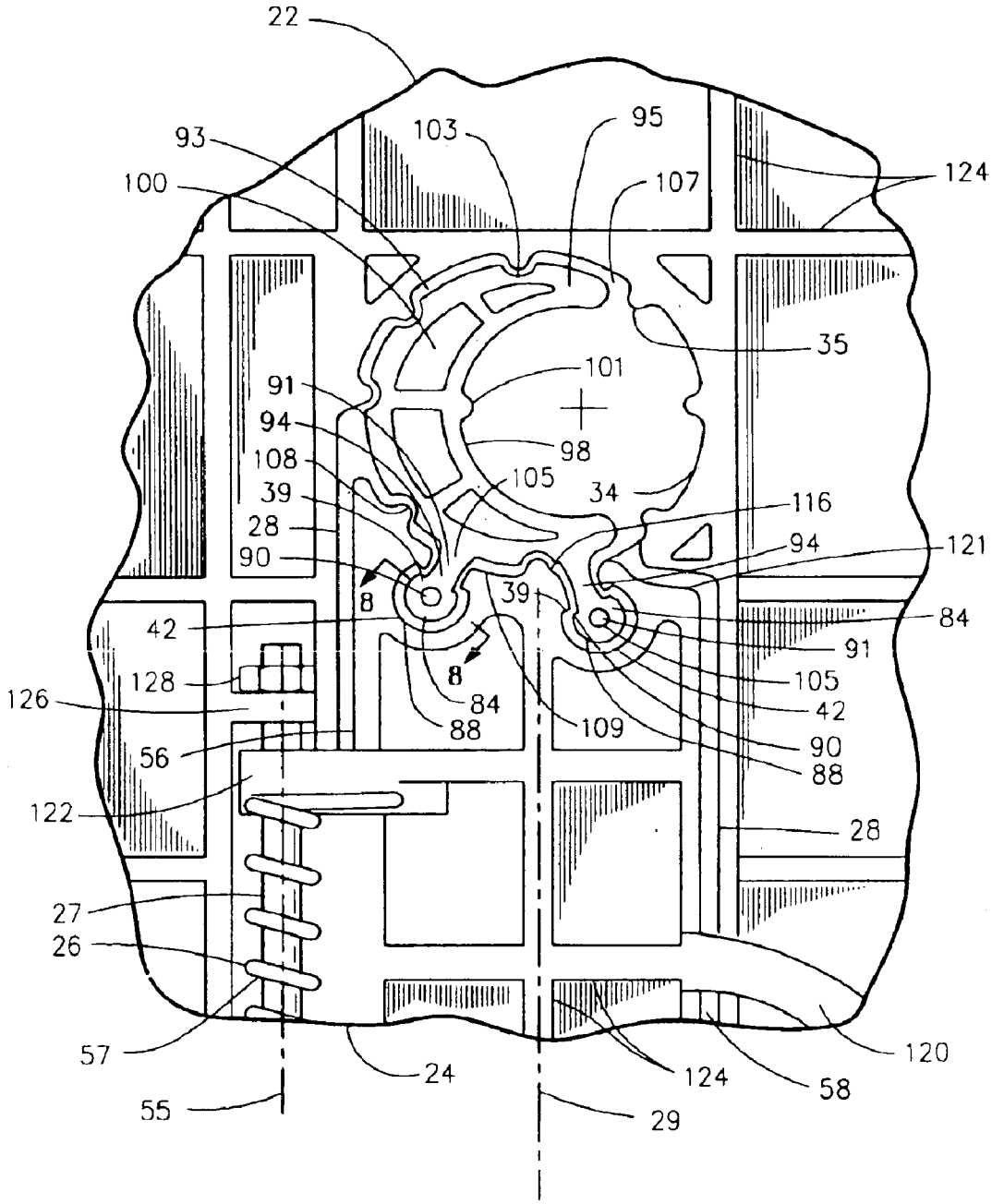
FIG. 3 shows an expanded back or rear view of the marine mooring line vermin shield assembly with the closure including the optional removable aperture inserted into the disc slot, resulting in the closure being in a closed state.

Further, looking to FIG. 3 shown is an expanded back or rear view of the marine mooring line vermin shield assembly 20 with the closure 24 and removable aperture 95 slidably engaged into the closure 24 second end 121, with the combination of the closure 24 and the aperture insert 95 inserted into the disc slot 28, resulting in the closure 24 being in a closed state. The disc radial slot 28 through the disc 22 is coincident to the disc axial axis 32 (as shown in FIG. 4), with the radial slot 28 extending from the aperture 34 to a periphery 36 (not shown) of the disc 22, the slot has a radial axis 29 parallel to the slot 28. More specifically, the marine mooring line vermin shield assembly 20 is shown in a back view from the side opposite of the substantially flush disc face (see FIG. 1) to clearly identify the components of the closure 24, the means 26 for urging the closure 24 from the open state to the closed state. As shown, the disc 22 and the closure 24 have multiple disc reinforcing rib 124 construction, alternatively the disc 22 and the closure 24 could be of a solid non rib construction. Also shown is the aperture 34 of the disc 22 that is a partially circular opening that utilizes the disc axial axis 32 (see FIG. 4) as a centerline.

The closure 24 as shown is in the closed state by being inserted into the slot 28 as urged by the means 26 for urging the closure 24 from the open state to the closed state. A mooring line passageway is formed by the disc aperture 34 and the aperture mooring line surface 98 of the aperture insert 95 or the closure mooring line surface 116, or as shown, if the aperture insert 95 is required depending upon the mooring line size as will be shown in FIG. 9 and FIG. 10. In other words, either the aperture mooring line surface 98 or as required for mooring line size the closure mooring line surface 116 act to compress 69 the mooring line (see FIG. 10) against the aperture 34.

The means 26 for urging the closure 24 from the open state into the closed state can be accomplished by any number of different methods. Preferably, a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 (one mount 126 being shown in FIG. 3) that are integral to the disc 22 and closure pivot mounts 122 (one mount 122 being shown in FIG. 3) that are integral to the closure 24 as shown. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the rod 27 and the nut 128 are preferably stainless steel or from other materials being acceptable for a marine environment.

The closure 24 has the finger pull 120 to ease the manual operation of pivoting the closure 24 from the closed state to the open state. The closure 24 second end 121 that in conjunction with the closure axial guide surface 116 is adapted to partially compress 69 the mooring line (see FIG. 10) against the aperture 34 when the closure is in the closed state, in other words when the aperture insert 95 is not required due to the size of the mooring line 72 (not shown). Looking more specifically to the aperture insert 95, the aperture insert 95 forms a minimal clearance gap 107 between the aperture insert 95 outer surface 93 and the disc 22 aperture 34 when the closure 24 is in the closed state to further complete the formation of a nearly solid disc, being the combination of the disc 22, the closure 24, and with the aperture insert 95 when required when the closure 24 is in the closed state. Also shown is the aperture insert 95 void side 100 which is opposite of the aperture insert 95 face side 96 (see FIG. 1) for proper orientation of the aperture insert 95 in the closure 24 second end 121. The attachment between the aperture insert 95 and the closure 24 is accomplished by a means 91 for removably interlocking the aperture insert 95 to the closure 24. Preferably the means 91 for removably interlocking the aperture insert 95 to the closure 24 utilizes fasteners 105 between the closure 24 and the aperture insert being described in more detail in FIGS. 5, 6, 7, and 8. Also, preferably, the means 91 for removably interlocking the aperture insert 95 to the closure 24 uses a closure second end 121 female frustroconical segment 42 and closure 24 second end 121 radial retainer 39 that both removably interlock with an aperture insert 95 ear 84 that comprises a matching aperture insert 95 ear 84 male frustroconical segment 88 and aperture insert 95 ear 84 radial retainer 90 that is adjacent to the aperture insert 95 outer surface 93 via a neck 94. To better grip the mooring line, protrusions 35 are on the disc aperture or mooring line surface 34 of the disc 22, protrusions 101 are on the concave portion or mooring line surface 98 of the aperture insert 95, and protrusions 108 are on the closure second end 121 mooring line surface 116 of the closure 24. The protrusions 35, 101, and 108 all function to help grip the mooring line 72 (see FIG. 11) thus assisting in preventing the vermin shield 20 from sliding axially along the mooring line axial axis 71 (see FIG. 11). The protrusions 35, 101, and 108 are preferably about one sixteenth of an inch high and wide, however, the protrusions could be larger or smaller depending upon the type of mooring line 72 (not shown) used. In addition, the number of protrusions 35, 101, and 108 could vary depending upon the type of mooring line 72 (not shown) used. As the vermin shield 20 can be used without the aperture insert 95 for the largest size mooring lines, the protrusions that exist in between both the closure 24 protrusions 108 and the disc aperture 34 protrusions 35 to the aperture insert 95 are accommodated by aperture insert 95 indentations 103 that provide clearance for the closure 24 protrusions 108 and the disc aperture 34 protrusions 35. The indentations 103 are slightly larger by about one thirty second of an inch than protrusions 35 and 108. Thus, functionally the indentations 103 on the aperture insert 95 outer surface 93 allow a close clearance 107 between the aperture insert 95 and the disc aperture 34 and a close clearance 109 between the closure 24 second end 121 axial guide surface 116 and the aperture insert 95, resulting in a nearly smooth face for the disc 22 face 30 (see FIG. 1), aperture insert 95 face 96 (see FIG. 1), and the closure 24 face 118 (see FIG. 1) in conjunction with the closure 24 clearances 56 and 58 to the disc 22 slot 28 for the purpose of making vermin passage along the mooring line more difficult around the vermin shield 22. Clearances 56, 58, 107, and 109 are preferably from about zero (0) to one sixteenth (1/16) of an inch. Note that the clearances 56, 58, 107, and 109 are exaggerated for drawing clarity appearing larger than actually desired.

Moving next to FIG. 4 shown is a perspective view of the marine mooring line vermin shield assembly 20 with the closure 24 and the removable aperture 95 extracted from the disc slot 28, resulting in the closure 24 being in an unlocked and open state. More specifically, the marine mooring line vermin shield assembly 20 is shown in a back view from the side opposite of the substantially flush disc face 30 (see FIG. 1) to clearly identify the components of the closure 24, the means 26 for urging the closure 24 from the open state to the closed state, and the lockable element 40 removed to allow the closure 24 to be placed in the open state as shown, however, the closure 24 opening 38 for the lockable element 40 and the disc 22 opening 37 for the lockable element 40 are shown. As shown, the disc 22 has multiple disc reinforcing rib 124 construction, alternatively the disc 22 could be of a solid non rib construction. Also shown is the aperture 34 of the disc 22 that is a partially circular opening that is coincident to the disc axial axis 32 that is perpendicular to the disc face (not shown) as a centerline for the aperture 34. The disc axial axis 32 is positioned in a central portion of the disc 22. The opening formed by the disk 22 aperture 34 is tangential to both sides of slot 28.

The closure 24 as shown is in the open state by being manually extracted from the slot 28 as manually urged using the closure finger pull 120 against the means 26 for normally urging the closure 24 from the open state to the closed state. A mooring line passageway is formed by the disc aperture 34 and the aperture mooring line surface 98 of the aperture insert 95 or the closure mooring line surface 116, or as shown, if the aperture insert 95 is required depending upon the mooring line size as will be shown in FIG. 9 and FIG. 10. In other words, either the aperture mooring line surface 98 or as required for mooring line size the closure mooring line surface 116 act to compress 69 the mooring line (see FIGS. 9 and 10) against the aperture 34.

The means 26 for urging the closure 24 from the open state into the closed state can be accomplished by any number of different methods. Preferably a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 integral to the disc 22 and closure pivot mounts 122 integral to the closure 24 as shown. Thus, the means 26 for urging the closure 24, being the rod 27 and spring 57 positioned on the rod 27 outside diameter is pivotally oriented along the pivotal axis 55 substantially parallel to the slot axis 29. The rod 27 and spring 57 can be constructed of preferably stainless steel or from other materials being acceptable being corrosion resistant for a marine environment. The rod 27 also includes a hinge pivot retention nut 128 (not shown) that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the nut 128 are preferably stainless steel or from other materials being acceptable for a marine environment.

The closure 24 has the finger pull 120 to ease the manual operation of pivoting the closure 24 from the closed state to the open state as shown. The closure 24 second end 121 that in conjunction with the closure axial guide surface 116 is adapted to partially compress 69 the mooring line (see FIGS. 9 and 10) against the aperture 34 when the closure is in the closed state, in other words when the aperture insert 95 is not required due to the size of the mooring line.

On the closure 24 itself, shown is the closure face 118 that is substantially flush with both the disc face (see FIG. 1) and the aperture insert face 96 when the closure 24 is in the closed state within the disc slot 28 along the slot opening radial axis 29 in the disc 22. The finger pull 120 also acts as a closure rest 60 as against a disc rest 44 to limit the closure 24 pivotal movement 25 from the means 26 for urging the closure 24 from the open state into the closed state, thus setting the closure 24 face 118 in the closed state to be flush with the disc 22 face 30 (see FIG. 1). As the closure 24 moves from the open state to the closed state and vice versa, the closure travels through the closure pivotal movement arc 25.

The closure 24 is sized and adapted to insert into the slot 28 in a closure pivotal movement arc 25 approximately parallel to the disc axial axis 32. The closure 24 is in a closed state when inserted into the slot 28 and is substantially flush on the portion of the closure face 118 with the disc face 30 (see FIG. 1). The closure 24 is also sized and adapted to manually extract from the slot 28 in the closure pivotal movement arc 25 approximately parallel to the disc axial axis 32, with the closure 24 being in an open state when extracted from the slot 28 to allow the marine mooring line 72 (see FIGS. 9, 10, and 11) to pass through the slot 28 from the periphery 36 to the aperture 34. The closure 24 including a first end 119 substantially flush with the disc periphery 36 when the closure 24 is in the closed state. The closure 24 also including an opposing second end 121 is adapted to partially compress 69 the mooring line against the aperture 34 if the aperture insert 95 is not required due to mooring line size, when the closure 24 is in the closed state (see FIGS. 9 and 10). The disc 22 resists axial movement 73 (see FIG. 11) along the mooring line 72 (see FIG. 11) when the closure 24 is in the closed state with the disc face 30 generally perpendicular to the mooring line axial axis 71 (see FIGS. 10 and 11).

The attachment between the aperture insert 95 and the closure 24 is accomplished by a means 91 for removably interlocking the aperture insert 95 to the closure 24. Preferably the means 91 for removably interlocking the aperture insert 95 to the closure 24 utilizes fasteners 105 between the closure 24 and the aperture insert being described in more detail in FIGS. 3, 5, 6, 7, and 8. To better grip the mooring line, protrusions 35 are on the disc aperture or mooring line surface 34 of the disc 22, protrusions 101 are on the concave portion or mooring line surface 98 of the aperture insert 95, and protrusions 108 are on the closure second end 121 mooring line surface 116 of the closure 24. The protrusions 35, 101, and 108 all function to help grip the mooring line 72 (see FIG. 11) thus assisting in preventing the vermin shield 20 from sliding axially along the mooring line axial axis 71 (see FIG. 11). The protrusions 35, 101, and 108 are preferably about one sixteenth of an inch high and wide, however, the protrusions could be larger or smaller depending upon the type of mooring line 72 (not shown) used. In addition, the number of protrusions 35, 101, and 108 could vary depending upon the type of mooring line 72 (not shown) used. As the vermin shield 20 can be used without the aperture insert 95 for the largest size mooring lines, the protrusions that exist inbetween both the closure 24 protrusions 108 and the disc aperture 34 protrusions 35 to the aperture insert 95 are accommodated by aperture insert 95 indentations 103 on the aperture insert 95 outer surface 93 that provide clearance for the closure 24 protrusions 108 and the disc aperture 34 protrusions 35. The indentations 103 are slightly larger by about one thirty second of an inch than protrusions 35 and 108. Thus, functionally the indentations 103 allow a close clearance 109 between the closure 24 second end 121 axial guide surface 116 and the aperture insert 95, resulting in a nearly smooth face for the disc 22 face 30 (see FIG. 1), aperture insert 95 face 96, and the closure 24 face 118.

Figure 5:
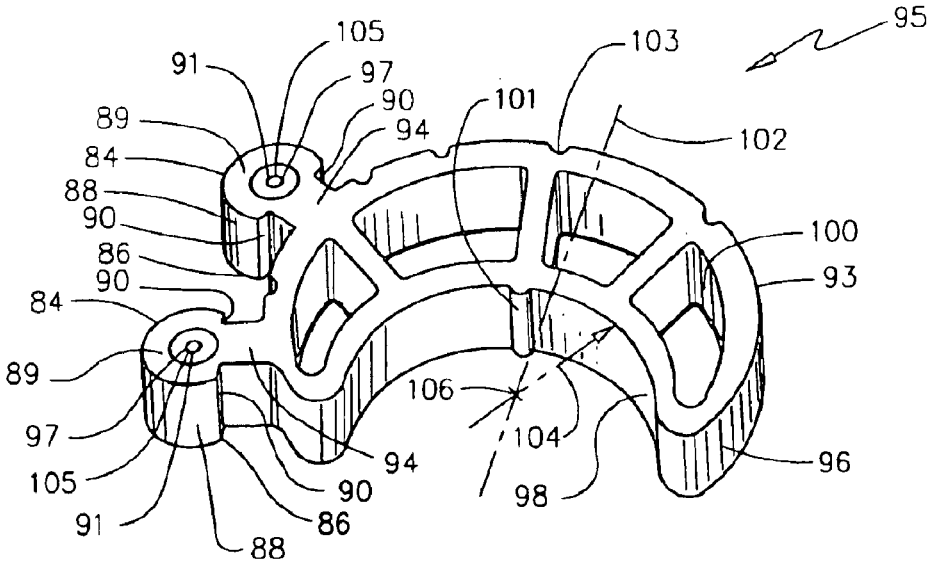
FIG. 5 shows an expanded perspective view of the aperture insert only on the void side that is removably engagable to the closure (not shown)
Figure 6:
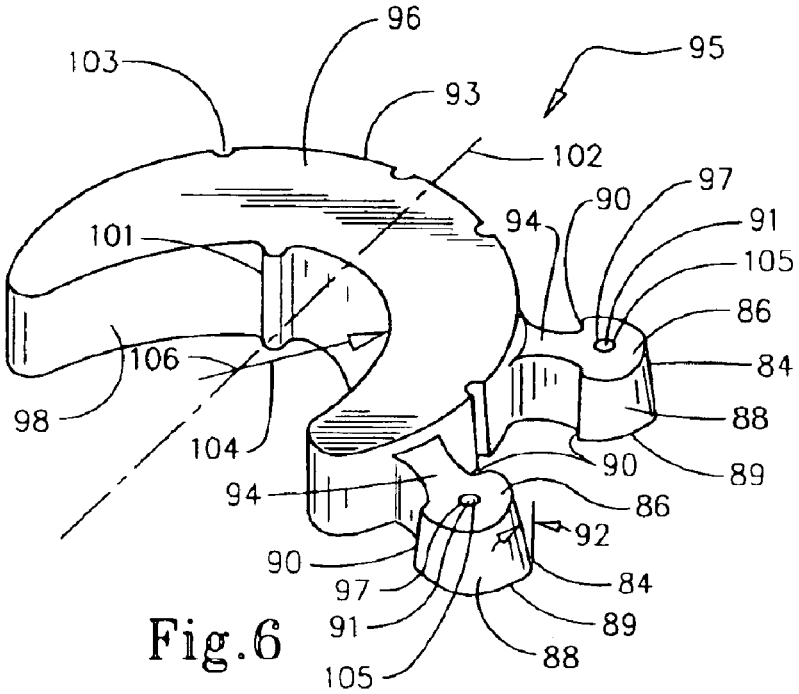
FIG. 6 shows an expanded perspective view of the aperture insert only on the non void or face side that is removably engagable to the closure (not shown)

Further, to FIGS. 5 and 6 shown is an expanded perspective view of the aperture insert 95 that that is removably interlocked or engaged to the closure 24 (not shown) however, as best shown in FIG. 3. The aperture insert 95 is shown on the void 100 side in FIG. 5 which is opposite of the aperture insert 95 face side 96 shown in FIG. 6. The attachment between the aperture insert 95 and the closure 24 (not shown) is accomplished by a means 91 (only shown for the aperture insert 95 portion) for removably interlocking or engaging the aperture insert 95 to the closure 24 (not shown). Preferably, the means 91 (only shown for the aperture insert 95 portion) for removably interlocking the aperture insert 95 to the closure 24 (not shown) comprises an ear 84 that includes the aperture insert 95 ear 84 male frustroconical segment 88 and aperture insert 95 ear 84 radial retainer 90. The ear 84 also includes an aperture insert 95 ear 84 small end 86 and an aperture insert 95 ear 84 large end 89. Between the small end 86 and the large end 89 the male frustroconical segment 88 forms a tapered frustroconical segment going from the large end 89 tapering inward to the small end 86 with the male frustroconical segment 88 terminating at the radial retainer 90 preferably in the form of a step that generally follows the male frustroconical segment 88 taper angle 92. The preferred angle 92 is about twenty (20) degrees plus or minus five (5) degrees, however, angle 92 could be more or less depending upon material, design, and functional considerations. As is shown in FIGS. 5 and 6 there are two radial retainers 90 per male frustroconical segment 88, however, a single radial retainer 90 per male frustroconical segment 88 would be acceptable also. The radial retainer 90 in conjunction with the male frustroconical segment 88 is adjacent to the aperture insert 95 outer surface 93 in the form of an ear 84 via the neck 94. Also, optionally included in the ear 84 located in a central portion of the male frustroconical segment 88 being positioned axially in relation to the male frustroconical segment 88 between the large end 89 and the small end 86 is the fastener 105 that include a fastener opening 97 therethrough that threadably receives the fastener 105 (see FIG. 8). Note that in FIGS. 5 and 6 two aperture insert 95 ears 84 are shown for the aperture insert 95, however, one ear 84 or more that two ears 84 would be acceptable also. The aforementioned aperture insert 95 ear 84 and specifically the male frustroconical segment 88 taper angle 92 and/or radial retainer 90 and/or uneven spacing between the use or two or more ears 84 act to force the aperture insert 95 into removable engagement with the closure 24 (not shown), being specifically the closure second end 121 (as shown in FIGS. 3 and 9) to engage one another in a singular positional orientation. In other words, to force the aperture insert 95 to only engage one way into the closure second end 121.

On the aperture insert 95 the protrusions 101 are located on the concave portion or the aperture insert 95 mooring line surface 98, the protrusions 101 function to help grip the mooring line 72 (see FIG. 11) thus assisting in preventing the vermin shield 20 from sliding axially along the mooring line axial axis 71 (see FIG. 11). The protrusions 101 are preferably about one sixteenth of an inch high and wide, however, the protrusions could be larger or smaller depending upon the type of mooring line 72 (not shown) used. In addition, the number of protrusions 101 could vary depending upon the type of mooring line 72 (not shown) used. As the vermin shield 20 can be used with or without the aperture insert 95 for the depending on the size of the mooring lines 72 (see FIGS. 9 and 10), the protrusions that exist inbetween both the closure 24 protrusions 108 (see FIG. 3) and the disc aperture 34 protrusions 35 (see FIG. 3) to the aperture insert 95 are accommodated by aperture insert 95 indentations 103 being located on the aperture insert 95 outer surface 93 that provide clearance for the closure 24 protrusions 108 (see FIG. 3) and the disc aperture 34 protrusions 35 (see FIG. 3). Thus the preferred size of the indentations 103 is about one thirty second of an inch larger than the aforementioned preferred size for the protrusions 35 and protrusions 108, thus the indentations 103 are functional to provide clearance for the protrusions 35 and for protrusions 108 thus minimizing clearance 107 (see FIG. 3) and clearance 109 (see FIG. 3).

As the purpose of the aperture insert 95 is to accommodate different sizes of mooring lines 72 (not shown), specifically relating to the different mooring line diameters, an aperture mooring line surface radius 104 of varying dimension or length is utilized to accommodate the different diameters of mooring lines. This radius 104 defines the aperture mooring line surface 98, which in effect compresses 69 the mooring line against the disc aperture or mooring line surface 34 (as best shown in FIGS. 9 and 10). The radius 104 originates from an aperture mooring line surface radius axis 102 that is in a central portion of the aperture insert 95, wherein the radius 104 intersects the radius axis 102 at an aperture mooring line surface radius intersection 106. Note, that as the radius 104 changes in length for different mooring line diameters the intersection point 106 moves along the radius axis 102 to maintain a more circular aperture in the marine mooring line vermin shield assembly from the combination of the disc aperture 34 and the aperture insert 95. In other words, as the disc aperture 34 is fixed (see FIG. 3) in configuration curvature, as the radius 104 becomes longer, the intersection point 106 preferably shifts toward the aperture mooring line surface 98 to have a more symmetrically circular aperture in the marine mooring line vermin shield assembly 20 from the combination of the disc aperture 34 the aperture insert 95. If the intersection 104 did not shift in the aforementioned manner the combination of the disc aperture 34 the aperture insert 95 opening would appear somewhat like two different size semi circles in shape causing a somewhat uneven compression of the mooring line in the marine mooring line vermin shield assembly 20 from the combination of the disc aperture 34 and the aperture insert 95.

Preferably, mooring line 72 diameters or sizes accommodated (not shown) are ½ inches, ⅝ inches, ¾ inches, ⅞ inches, 1 inches, 1½ inches, 1¾ inches, 2 inches, 2¼inches, and 2½inches, however, sizes either larger or smaller that the aforementioned could be easily accommodated by the present invention. Note that, on the largest size of mooring line diameter no aperture insert 95 would by used as the closure second end 121 (see FIG. 7 with the mooring line 72 positioned as in FIGS. 9 and 10) alone would act to compress 69 the mooring line 72, with smaller sizes of mooring lines 72 using different aperture inserts 95 that each have a different length radius 104 with a preferably shifting intersection point 106 as previously discussed. Another manufacturing convenience is the aperture 95 void 100 being optionally utilized for manufacturing convenience. The marine mooring line vermin shield assembly 20 would typically include a plurality of aperture inserts 95 each with a different length radius 104 allowing a single marine mooring line vermin shield assembly 20 to accommodate various mooring line sizes.

Figure 7:
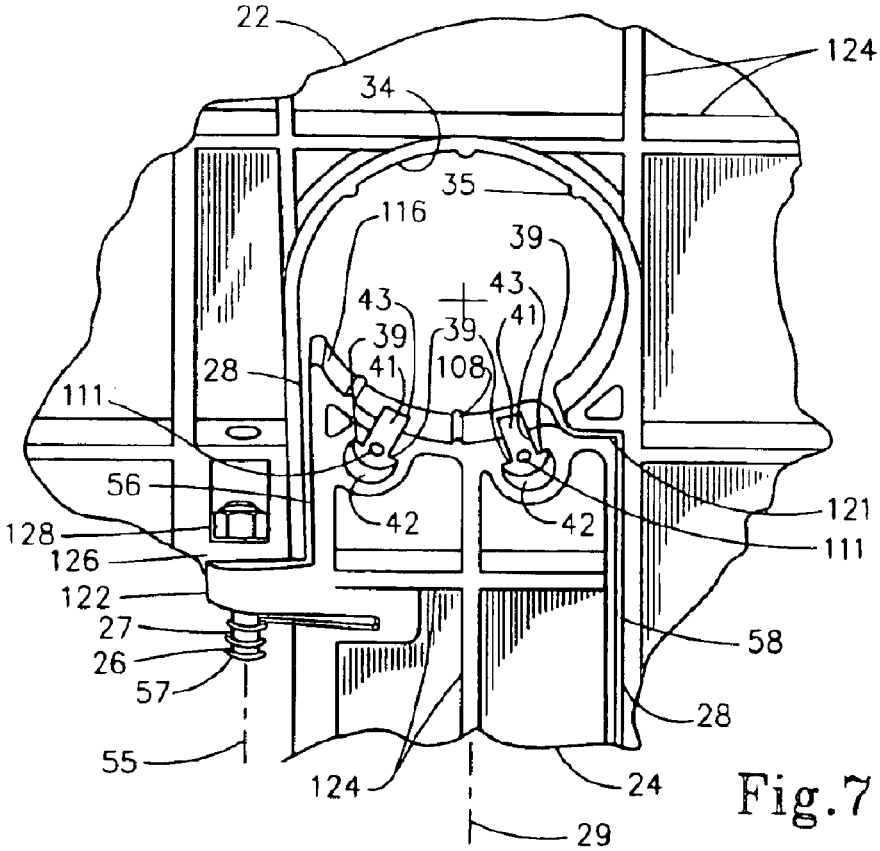
FIG. 7 shows a perspective expanded back or rear view of the marine mooring line vermin shield with the closure in a closed state, not including the optional removable aperture inserted into the disc slot, to show the detail of the closure second end aperture insert attachment.

Further, looking to FIG. 7 shown is an expanded back or rear view of the marine mooring line vermin shield assembly 20 including the closure 24, however, with the removable aperture insert 95 removed as would be the case in using the larger marine mooring line 72 diameter or size (see FIG. 10). The closure 24 and more specifically the closure 24 second end 121, are shown inserted into the disc slot 28, resulting in the closure 24 being in a closed state. The disc radial slot 28 through the disc 22 is coincident to the disc axial axis 32 (as shown in FIG. 4), with the radial slot 28 extending from the aperture 34 to a periphery 36 (not shown) of the disc 22, the slot has a radial axis 29 parallel to the slot 28. More specifically, the marine mooring line vermin shield assembly 20 is shown in a back view from the side opposite of the substantially flush disc face (see FIG. 1) to clearly identify the components of the closure 24, the means 26 for urging the closure 24 from the open state to the closed state. As shown, the disc 22 and the closure 24 have multiple disc 22 and closure 24 reinforcing rib 124 construction, alternatively the disc 22 and the closure 24 could be of a solid non rib construction. Also shown is the aperture 34 of the disc 22 that is a partially circular opening that utilizes the disc axial axis (see FIG. 4) as a centerline.

The closure 24 as shown is in the closed state by being inserted into the slot 28 as urged by the means 26 for urging the closure 24 from the open state to the closed state. A mooring line passageway is formed by the disc aperture or mooring line surface 34 and the closure mooring line surface 116, or if the aperture insert 95 (not shown) is required depending upon the mooring line 72 size (not shown) as will be shown in FIG. 9 and FIG. 10 (without the aperture insert 95). In other words, either the aperture insert 95 mooring line surface 98 or as required for mooring line 72 size or the closure mooring line surface 116 act to compress the mooring line 72 against the aperture 34.

The means 26 for urging the closure 24 from the open state into the closed state can be accomplished by any number of different methods. Preferably, a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 (one mount 126 being shown in FIG. 7) that are integral to the disc 22 and closure pivot mounts 122 (one mount 122 being shown in FIG. 7) that are integral to the closure 24 as shown. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the rod 27 and the nut 128 are preferably stainless steel or from other materials being acceptable for a marine environment.

The attachment between the aperture insert 95 (not shown) and the closure 24 is accomplished by a means 91 for removably interlocking or engaging the aperture insert 95 to the closure 24. Preferably the means 91 for removably interlocking the aperture insert 95 to the closure 24 (with the closure 24 portion shown and described here, see FIGS. 5 and 6 for the aperture insert 95 portion of the means 91 for removably interlocking the aperture insert 95 to the closure 24) includes in the second end 121 of the closure 24, a closure 24 second end 121 female frustroconical segment 42 terminating in a closure 24 second end 121 retainer 39 that communicates via a closure second end 121 channel 43 to the closure second end 121 mooring line surface 116. The aforementioned female frustroconical segment 42 terminating in the retainer 39 that communicates via a channel 43 to the mooring line surface 116 is sized and adapted to removably engage the previously discussed aperture insert 95 ear 84 including substantially mating or matching taper angles (previously defined as angle 92 for the ear 84 male frustroconical segment 88) between the aperture insert 95 male frustroconical segment 88 and the female frustroconical segment 42 being functional or operational to "wedge" the male frustroconical segment 88 into the female frustroconical segment 42, thus retaining the aperture insert 95 into the closure 24 second end 121. The mating between the aperture insert 95 ear 84 retainer 90 and the closure 24 second end 121 retainer 39 are functional or operational to retain the aperture insert 95 in the closure 24 second end 121 substantially parallel to the slot 28 radial axis 29 in the disc 22. The neck 94 of the aperture insert 95 slidably engages the channel 43 of the closure 24 second end 121. Although two closure 24 second end 121 retainers 39 are shown, a single one or more than two retainers 39 could be used as long as the retainers 90 on the aperture insert 95 match in number and engage on the same side of the slidable engagement of the neck 94 and channel 43 for the closure 24 second end 121 retainer 39. In addition, although two closure 24 second end 121 combination female frustroconical segments 42, retainers 39, and channels 43 are shown, one or more than two combination female frustroconical segments 42, retainers 39, and channels 43 could be used as long as the aforementioned combination matches in size, number, and spacing as the aperture insert 95 ear 84 to facilitate the previously described removable engagement between the aperture insert 95 and the closure 24 second end 121. Optionally, to assist in retaining the aperture insert 95 to the closure 24 second 121, a shoulder 41 and opening 111 are in the closure 24 second end 121 to facilitate the use of a fastener 105 (see FIG. 8).

To better grip the mooring line, protrusions 35 are on the disc aperture or mooring line surface 34 of the disc 22 and protrusions 108 are on the closure second end 121 mooring line surface 116 of the closure 24. The protrusions 35 and 108 all function to help grip the mooring line 72 (see FIG. 11) thus assisting in preventing the vermin shield 20 from sliding axially along the mooring line axial axis 71 (see FIG. 11). The protrusions 35 and 108 are preferably about one sixteenth of an inch high and wide, however, the protrusions could be larger or smaller depending upon the type of mooring line 72 (not shown) used. In addition, the number of protrusions 35 and 108 could vary depending upon the type of mooring line 72 (not shown) used.

Figure 8:
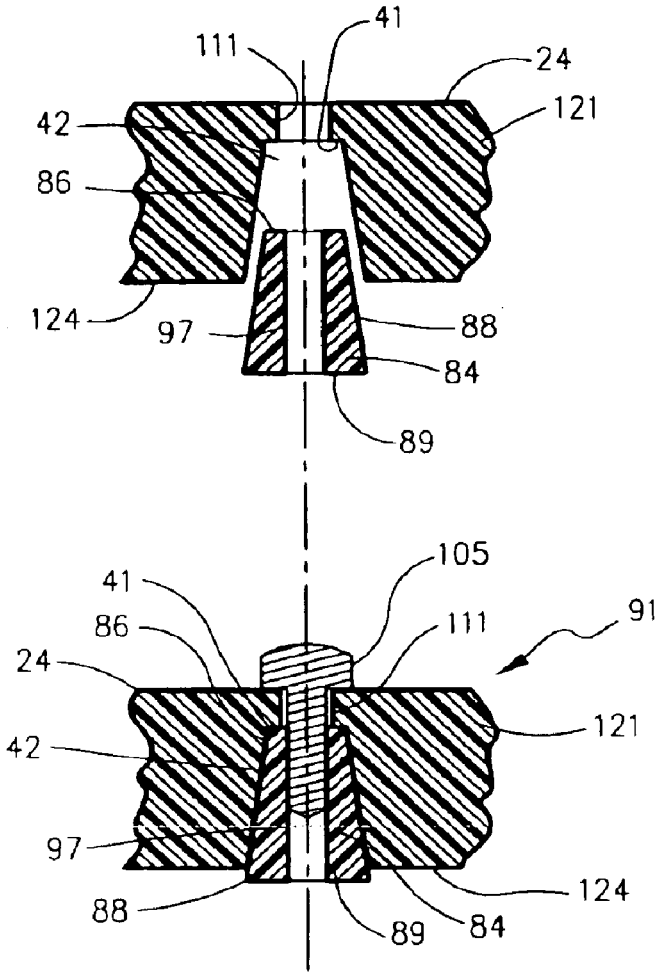
FIG. 8 shows section 8—8 from FIG. 3 of the marine mooring line vermin shield assembly, both pre and post assembly, specifically detailing the means for attaching the optional aperture insert to the closure second end.

Further, looking next to FIG. 8 shown is section 8—8 from FIG. 3 of the marine mooring line vermin shield assembly 20, both pre and post assembly, specifically detailing the means 91 for attaching the optional aperture insert 95 to the closure 24 second end 121. Shown on the closure second end 121 is the female frustroconical segment 42 along with the optional shoulder 41 and fastener 105 opening 111 as described in the FIG. 7 description. On the aperture 95 insert shown is a portion of the ear 84 that includes the large end 89, the male frustroconical segment 88 that tapers inward (at the angle 92 as shown in FIG. 6), from the large end 89 to the small end 86. In addition, the fastener opening 97 is shown that is located in a central portion of the frustroconical segment 88 with the fastener opening 97 therethrough the frustroconical segment 88 going between the large end 89 to the small end 86. As shown in the view with the fastener 105, the opening 97 threadably receives the fastener 105, thereby helping secure the shoulder 41 of the closure second end 121 through the opening 111 to the male frustroconical segment 88 resulting in helping to secure the aperture insert 95 to the closure 24.

As previously discussed in FIG. 7 the substantially matching taper between the male frustroconical segment 88 and the female frustroconical segment 42 is best shown in the view with the fastener 105 with a resulting gap between the shoulder 41 and the small end 86 to accomplish the previously described "wedging" function.

Note that this "wedging" function requires that the distance between the large end 86 and the small end 89 be larger or longer that the distance from the shoulder 41 to the closure second end 121 reinforcing rib 124 to prevent the gap between the shoulder 41 and the small end 86 to not exist thus allowing contact between the shoulder 41 and the small end 86 resulting in there being no "wedging" function.

Further, looking to FIG. 9 shown is an expanded back or rear view of the marine mooring line vermin shield assembly 20 with the closure 24 and removable aperture 95 slidably engaged into the closure 24 second end 121, with the combination of the closure 24 and the aperture insert 95 inserted into the disc slot 28, resulting in the closure 24 being in a closed state. The disc radial slot 28 through the disc 22 is coincident to the disc axial axis 32 (as shown in FIG. 4), with the radial slot 28 extending from the aperture 34 to a periphery 36 (not shown) of the disc 22, the slot has a radial axis 29 parallel to the slot 28. More specifically, the marine mooring line vermin shield assembly 20 is shown in a back view from the side opposite of the substantially flush disc face (not shown) to clearly identify the components of the closure 24, the means 26 for urging the closure 24 from the open state to the closed state. As shown, the disc 22 and the closure 24 have multiple disc reinforcing rib 124 construction, alternatively the disc 22 and the closure 24 could be of a solid non rib construction. Also shown is the aperture 34 of the disc 22 that is a partially circular opening that utilizes the disc axial axis (see FIG. 4) as a centerline.

The closure 24 as shown is in the closed state by being inserted into the slot 28 as urged by the means 26 for urging the closure 24 from the open state to the closed state. A mooring line passageway is formed by the disc aperture 34 and the aperture mooring line surface 98 of the aperture insert 95 or the closure mooring line surface 116, or as shown, if the aperture insert 95 is required depending upon the mooring line size. In other words, either the aperture mooring line surface 98 or as required for mooring line size the closure mooring line surface 116 act to compress 69 the mooring line 72 against the aperture 34 (see also FIG. 10).

The means 26 for urging the closure 24 from the open state into the closed state can be accomplished by any number of different methods. Preferably, a spring element 57 positioned around the rod 27 outside diameter engaging the disc 22 on one end and the closure 24 on the other end is operational to accomplish the means 26 for urging the closure 24 from the open state into the closed state. Alternatively, a torsion rod, elastomeric element, or the like could be used to function as the means 26 for urging the closure 24 from the open state into the closed state while meeting the functional requirements and for operation in a marine environment. Preferably, as shown a hinge pivot bolt rod 27 having a pivotal axis 55 is mounted through disc pivot mounts 126 (one mount 126 being shown in FIG. 9) that are integral to the disc 22 and closure pivot mounts 122 (one mount 122 being shown in FIG. 9) that are integral to the closure 24 as shown. The rod 27 also includes a hinge pivot retention nut 128 that can be self locking to hold the rod 27 within the disc pivot mounts 126 and a spring element 57 to bias or urge the closure 24 to pivot into the closed state as shown. The function of the nut 128 could also be accomplished by swaging the rod 27 end, crimping a sleeve, having a shrink fit collar or any other element known in the art. The materials of construction of the rod 27 and the nut 128 are preferably stainless steel or from other materials being acceptable for a marine environment.

The closure 24 has the finger pull 120 to ease the manual operation of pivoting the closure 24 from the closed state to the open state. The closure 24 second end 121 that in conjunction with the closure axial guide surface 116 is adapted to partially compress the mooring line 72 against the aperture 34 when the closure is in the closed state, in other words when the aperture insert 95 is not required due to the size of the mooring line. Looking more specifically to the aperture insert 95, the aperture insert 95 forms a minimal clearance gap 107 between the aperture insert 95 outer surface 93 and the disc 22 aperture 34 when the closure 24 is in the closed state to further complete the formation of a nearly solid disc, being the combination of the disc 22, the closure 24, and with the aperture insert 95 when required when the closure 24 is in the closed state. Also shown is the aperture insert 95 void side 100 which is opposite of the aperture insert 95 face side 96 (see FIG. 1) for proper orientation of the aperture insert 95 in the closure 24 second end 121. The attachment between the aperture insert 95 and the closure 24 is accomplished by a means 91 for removably interlocking the aperture insert 95 to the closure 24. Preferably the means 91 for removably interlocking the aperture insert 95 to the closure 24 utilizes fasteners 105 between the closure 24 and the aperture insert being described in more detail in FIGS. 5, 6, 7, and 8. Also, preferably, the means 91 for removably interlocking the aperture insert 95 to the closure 24 uses a closure second end 121 female frustroconical segment 42 and closure 24 second end 121 radial retainer 39 that both removably interlock with an aperture insert 95 ear 84 that comprises a matching aperture insert 95 ear 84 male frustroconical segment 88 and aperture insert 95 ear 84 radial retainer 90 that is adjacent to the aperture insert 95 outer surface 93 via a neck 94. To better grip the mooring line, protrusions 35 are on the disc aperture or mooring line surface 34 of the disc 22, protrusions 101 are on the concave portion or mooring line surface 98 of the aperture insert 95, and protrusions 108 are on the closure second end 121 mooring line surface 116 of the closure 24. The protrusions 35, 101, and 108 all function to help grip the mooring line 72 thus assisting in preventing the vermin shield 20 from sliding axially along the mooring line axial axis 71 (see FIG. 11). The protrusions 35, 101, and 108 are preferably about one sixteenth of an inch high and wide, however, the protrusions could be larger or smaller depending upon the type of mooring line 72 used. In addition, the number of protrusions 35, 101, and 108 could vary depending upon the type of mooring line 72 used. As the vermin shield 20 can be used without the aperture insert 95 for the largest size mooring lines, the protrusions that exist inbetween both the closure 24 protrusions 108 and the disc aperture 34 protrusions 35 to the aperture insert 95 are accommodated by aperture insert 95 indentations 103 that provide clearance for the closure 24 protrusions 108 and the disc aperture 34 protrusions 35. The indentations 103 are slightly larger by about one thirty second of an inch than protrusions 35 and 108. Thus, functionally the indentations 103 on the aperture insert 95 outer surface 93 allow a close clearance 107 between the aperture insert 95 and the disc aperture 34 and a close clearance 109 between the closure 24 second end 121 axial guide surface 116 and the aperture insert 95, resulting in a nearly smooth face for the disc 22 face 30 (see FIG. 1), aperture insert 95 face 96 (see FIG. 1), and the closure 24 face 118 (see FIG. 1) in conjunction with the closure 24 clearances 56 and 58 to the disc 22 slot 28 for the purpose of making vermin passage along the mooring line more difficult around the vermin shield 22. Clearances 56, 58, 107, and 109 are preferably from about zero (0) to one sixteenth (1/16) of an inch. Note that the clearances 56, 58, 107, and 109 are exaggerated for drawing clarity appearing larger than actually desired.

Further, proceeding on to FIG. 10 shown is section 10—10 from FIG. 9 of the marine mooring line vermin shield assembly with the closure 24, however, without the aperture insert 95 (see FIG. 7), and the closure second end 121 inserted into the disc 22 slot (not shown), resulting in the closure 24 being in a closed state, the marine mooring line 72 being compressed 69 between the disc aperture 34 and the closure second end 121 mooring line surface 116. The mooring line 72 is shown passing through the passageway formed by the aperture 34 and the closure mooring line surface 116, (again as best shown in FIG. 3, however, having the aperture insert 95 included) (or as shown in FIG. 9, however, having the aperture insert 95 included), if the aperture insert 95 is required depending upon the mooring line 72 diameter. In other words, either the aperture mooring line surface 98 or as required for the mooring line 72 diameter the closure mooring line surface 116 being a portion of the closure second end 121 act to compress the mooring line 72 against the aperture 34. When the closure 24 is in the closed state the aperture insert 95 when properly installed has a face 96 that is substantially flush with both the disc face 30 and the closure face 118.

Thus, with the closure 24 being in the closed state, more particularly, shown is the compression 69 of the mooring line 72 between the aperture 34 and either the aperture insert 95 or the closure mooring line surface 116. This compression of the mooring line 72 occurs at the portion of the mooring line 72 identified as compression 69 with the purpose of securing the mooring line vermin shield assembly 20 from axial movement along the mooring line 72 approximately along the mooring line axial axis 71. In addition, the aforementioned securing compression 69 of the mooring line 72 helps to keep the disk face 30 generally perpendicular to the mooring line axial axis 71, in relation to the disc axial axis 32, with the purpose being to maximize the difficulty for the vermin crawling along the mooring line 72 to overcome the shield assembly 20 in attempting to gain passage to the pleasure craft on the opposite side of the vermin shield assembly 20 (see FIG. 11). Also shown is the placement area for the pleasure craft registration number 31 being on the same side as the disc face 30. The mooring line 72 which is termed in the art as either nylon anchor line, nylon mooring line, braided nylon anchor line, twisted nylon anchor line, or poly anchor line is preferred as it is required that the mooring line be compressible to some extent. The amount of compression 69 on the mooring line 72 when the closure 24 is in the closed state for the purpose of securing the vermin shield assembly 20 to the mooring line 72 is preferably about one sixteenth of an inch as previously described.

Method of Use

Finally, looking to FIG. 11 shown is the marine mooring line vermin shield assembly 20 in use placed on a marine mooring line 72 that secures the pleasure craft 78 to the shoreline 74 or dock 74. Starting with the pleasure craft 78 which can be a conventional speedboat, water skiing boat, small fishing boat, sailboat, a houseboat, or any other type of smaller marine craft. The pleasure craft 78 is floating in the body of water 76 in close proximity to land, which includes either an undeveloped shoreline 74 or a dock 74 or a marina 74. There is a deck cleat 79 shown on the pleasure craft 78 for attaching the mooring line 72 to the deck of the pleasure craft 78. Normally the other end of the mooring line 72 will either be secured to a dock cleat 81 that is mounted to the dock or marina 74 or in the case where there is no dock or marina an anchor will be used 82 that is attached to the other end of the mooring line 72 that is secured to the shoreline 74 by either burying the anchor 82 along the shoreline or securing the anchor to a rock and the like. Although a singular mooring line 72 is shown for pictorial simplicity, typically a plurality of mooring lines 72 are used to prevent the pleasure craft 78 from swinging in a pendulum type action in relation to the dock or shoreline 74 from either wind or water currents thus potentially causing damage to the pleasure craft 78 from the pleasure craft 78 contacting the dock or shoreline 74. In most cases, two mooring lines 72 are used to secure the pleasure craft 78 from the potentially damaging pendulum swinging motion. For an even larger pleasure craft 78 such as a houseboat, four mooring lines 72 are typically used to secure the pleasure craft 78 from the potentially damaging pendulum swinging motion. Note that, each mooring line 72 requires at least one mooring line vermin shield assembly 20, thus most pleasure craft 78 would require two to four mooring line vermin shield assemblies 20.

The principal purpose of the mooring line vermin shield assembly 20 is to prevent the passage of a vermin 80 from crawling along the mooring line 72 from the dock 74, marina 74, or shoreline 74 and onto the pleasure craft 78. The mooring line vermin shield assembly 20 is provided that includes a disc, with an aperture, and a slot, also a closure, an aperture insert, a lock, and a means for urging the closure to insert into the slot resulting in the closure being in a closed state as previously described. To install the mooring line vermin shield assembly 20 the closure must be manually extracted from the slot (see FIG. 4), which requires that the means for urging the closure to insert into the slot must be manually overcome to extract the closure from the slot thus opening up the slot into the aperture that is placed at the center of the disc moving the closure from the closed state to the open state. Next, the size or diameter of the mooring line 72 needs to be determined or ascertained. Further a step of engaging the aperture insert into the closure if required based upon the determined size of the mooring line and at this point the mooring line vermin shield assembly 20 is ready to be positioned onto the mooring line 72 such that the mooring line 72 passes through the slot of the disc to rest against the disc aperture. It is important to note that the disc face 30 should be positioned on the mooring line 72 to face the dock 74 or shoreline 74 as shown. This is to ensure that the substantially flush disk surface 30 is the barrier that the vermin 80 encounters first while crawling along the mooring line 72 from the dock 74, marine 74, or shoreline 74. The next step would be to allow the means for urging the closure to insert the closure into the slot, thus putting the closure in the closed state, wherein at this point the closure will compress the mooring line 72 against the aperture of the disc and securing the mooring line vermin shield assembly 20 against axial movement 73 along a mooring line axial axis 71. The securing of the mooring line vermin shield assembly 20 to the mooring line 72 accomplishes three basic purposes, the first is to secure the vermin shield assembly 20 from moving along the mooring line 72 in the direction of axial movement along the mooring line 73, as the mooring line 72 is typically inclined as shown, secondly it is important to maintain the disc face 30 generally perpendicular to the mooring line axial axis 71 to maximize the barrier effect against the vermin 80. Thirdly, an optional lockable element 40 (not shown) can be used on the mooring line vermin shield assembly 20 to secure the closure in a closed state thus helping prevent theft of the mooring line vermin shield assembly 20. Additionally, it is important to position the mooring line vermin shield assembly 20 axially on the mooring line 72 a sufficient distance from the dock or shoreline 74 such that the vermin 80 cannot jump or leap onto the mooring line 72 that is between the mooring line vermin shield assembly 20 and the pleasure craft 78 thus allowing the vermin 80 to overcome the barrier. It is recommended the mooring line vermin shield assembly 20 be positioned on the mooring line 72 at an axial location approximately one half way between the shoreline anchor 82, dock cleat 81, dock 74, or shoreline 74, and the pleasure craft 78 or the mooring line cleat 79 on the pleasure craft 78. Optionally, an identification for the mooring vermin shield 20 the pleasure craft registration number can be added to the disc face 30 in the area 31 to associate the mooring line vermin shield 20 to the pleasure craft 78.

Optional further steps could include providing the marine mooring line vermin shield assembly 20 with a plurality of aperture inserts to be selected from based upon mooring line size if required. Also, a step could be included of engaging a selected aperture insert into the closure if required based upon the size of the mooring line.

Comparing the present invention to the prior art that uses either semi circular halves of the disc that mate together around the mooring line, or gravity swing doors covering a slot in the disc, or a slot with a resilient cover, the present invention is a more positive system for mounting the disc on the mooring line. This is because the urging means 26 secures the disc 22 to the mooring line without the need for fitting together large halves of a vermin guard, and is more secure in preventing vermin from getting around or through the barrier than either a gravity swing door or a resilient slot cover.

CONCLUSION

Accordingly, the present invention of a marine mooring line vermin shield has been described with some degree of particularity directed to the embodiments of the present invention. It should be appreciated, though, that the present invention is defined by the following claims construed in light of the prior art so modifications or changes may be made to the exemplary embodiments of the present invention without departing from the inventive concepts contained therein.

What is claimed is:

1. A marine mooring line vermin shield to prevent the passage of vermin crawling along a marine mooring line from land to a pleasure craft, comprising:

(a) a disc having a disc axial axis perpendicular to a face of said disc, the disc axial axis being positioned in a central portion of said disc, said disc also includes an aperture through said disc coincident to the disc axial axis being positioned such that said aperture uses the disc axial axis as a centerline, said aperture is sized and configured as a passage for the marine mooring line, said disc also includes a radial slot through said disc coincident to the disc axial axis, said radial slot extending from said aperture to a periphery of said disc, said slot having a radial axis parallel to said slot;

(b) an aperture insert including a male frustroconical segment terminating in a radial retainer that is in the form of an ear relative to said aperture insert;

(c) a closure sized and adapted to insert into said slot in a closure pivotal movement arc approximately parallel to the disc axial axis, said closure is in a closed state when inserted into said slot and is substantially flush with said disc face, said closure also sized and adapted to manually extract from said slot in the closure pivotal movement arc approximately parallel to the disc axial axis, said closure is in an open state when extracted from said slot to allow the marine mooring line to pass through said slot from said periphery to said aperture, said closure including a first end substantially flush with said disc periphery when said closure is in the closed state, said closure also including an opposing second end, said closure second end is sized and configured to removably interlock said aperture insert, said closure second end also includes a female frustroconical segment terminating in a radial retainer that is in communication with a closure second end axial guide surface, wherein said female frustroconical segment terminating in a radial retainer and said male frustroconical segment terminating in a radial retainer are removably interlock able, being operational to removably retain said aperture insert on said closure second end, with said aperture insert adapted to partially compress the mooring line against said aperture when said closure is in the closed state, wherein said disc resists axial movement along the mooring line when said closure is in the closed state with said disc face generally perpendicular to a mooring line axial axis; and (d) for urging said closure from the open state to the closed state.

2. A marine mooring line vermin shield according to claim 1 wherein said disc is constructed of a material with a mass density less than water such that said marine mooring line vermin shield floats in water.

3. A marine mooring line vermin shield according to claim 2 wherein said disc is constructed of materials selected from the group consisting essentially of polyethylene, polypropylene, and polyurethane materials.

4. A marine mooring line vermin shield according to claim 1 wherein said closure is constructed of a corrosion resistant material.

5. A marine mooring line vermin shield according to claim 1 further comprising a lockable element to secure said closure in the closed state.

6. A marine mooring line vermin shield according to claim 5 wherein said lockable element is constructed of a corrosion resistant material.

7. A marine mooring line vermin shield according to claim 1 wherein said disc face is a smooth substantially continuous surface with the exception of the marine mooring line protruding therefrom, when said closure is in the closed state, wherein the vermin encounters said disc face while crawling along the mooring line to help prevent passage of the vermin beyond said disc face.

8. A marine mooring line vermin shield according to claim 1 wherein said disc face has an area for placement of a pleasure craft registration number.

9. A marine mooring line vermin shield according to claim 1 wherein said means for urging said closure is pivotally oriented substantially parallel to the slot radial axis.

10. A marine mooring line vermin shield according to claim 9 further comprising a rod with a pivotal axis that is oriented substantially parallel to the slot radial axis.

11. A marine mooring line vermin shield according to claim 10 further comprising a spring element.

12. A marine mooring line vermin shield according to claim 11 wherein said rod and spring element are constructed of a corrosion resistant material.

13. A marine mooring line vermin shield according to claim 1 further comprising a plurality of aperture inserts that are operational to accommodate different sizes of mooring lines.

14. A marine mooring line vermin shield according to claim 1 wherein said closure second end and said aperture insert engage one another in a singular positional orientation.

15. A marine mooring line vermin shield according to claim 1 further comprising a fastener between a closure second end female frustroconical shoulder and said male frustroconical segment, being operational to further retain said aperture insert on said closure second end.

16. A method of using a marine mooring line vermin shield to prevent the passage of vermin crawling along a marine mooring line from land to a pleasure craft, comprising the steps of:

(a) providing a marine mooring line vermin shield that includes a disc, with an aperture, and a slot, also a closure, an aperture insert, a fastener, a lockable element, and a means for urging said closure to insert into said slot resulting in said closure being in a closed state;

(b) extracting said closure from said slot to place said closure in an open state by manually overcoming said means for urging;

(c) ascertaining the size of the mooring line;

(d) engaging said aperture insert into said closure if required based upon the size of the mooring line;

(e) inserting said fastener between said closure and said aperture insert to further retain said aperture insert on said closure;

(f) positioning said slot to allow the marine mooring line to pass through said slot and to rest against said aperture such that said disc is positioned so that a substantially flush disc face faces the land; and (g) allowing said means for urging closure to insert said closure into said slot placing said closure in the closed state, wherein said closure compresses the marine mooring line against said aperture to secure said marine mooring line vermin shield against axial movement on the marine mooring line.

17. A method of using a marine mooring line vermin shield according to claim 16 further comprising a step of locking said closure in the closed state after said step (g) using said lockable element.

18. A method of using a marine mooring line vermin shield according to claim 16 wherein said step of positioning includes an axial positioning of said aperture on the mooring line at an axial axis mooring line approximate midpoint between a mooring line cleat on the pleasure craft and a dock cleat.

19. A method of using a marine mooring line vermin shield according to claim 16 wherein said step of positioning includes an axial positioning of said aperture on the mooring line at an axial axis mooring line approximate midpoint between a mooring line cleat on the pleasure craft and an anchor on a shoreline.

20. A method of using a marine mooring line vermin shield according to claim 16 wherein said step of providing said marine mooring line vermin shield further comprises a plurality of aperture inserts to be selected from based upon mooring line size if required.

21. A method of using a marine mooring line vermin shield according to claim 20 wherein said step of engaging further comprises engaging a selected aperture insert into said closure if required based upon the size of the mooring line and inserting said fastener between said closure and said selected aperture insert to further retain said selected aperture insert on said closure.

* * * * *